United States Patent [19]

Hoppmann et al.

[11] Patent Number: 4,848,800

[45] Date of Patent: Jul. 18, 1989

[54] RETRIEVAL LABEL

[75] Inventors: Kurt H. Hoppmann; Horst A. Schober, both of Falls Church, Va.

[73] Assignee: Hoppmann Corporation, Chantilly, Va.

[21] Appl. No.: 149,487

[22] Filed: Jan. 28, 1988

[51] Int. Cl.[4] ..... B42D 5/00; B42D 1/02; B42D 15/00

[52] U.S. Cl. ..... 283/101

[58] Field of Search ..... 283/21, 22, 72, 81, 283/82, 83, 101; 235/61 D, 58 CW, 462, 493; 428/40, 41, 243; 281/DIG. 11; 40/17

[56] References Cited

U.S. PATENT DOCUMENTS

| | | | |
|---|---|---|---|
| 3,684,869 | 8/1972 | Relter | 283/82 |
| 3,895,220 | 7/1975 | Nelson et al. | 283/82 |
| 4,061,808 | 12/1977 | Sato | 283/101 |
| 4,180,284 | 12/1979 | Ashley | 283/101 |
| 4,215,879 | 8/1980 | Blum | 283/101 |
| 4,507,550 | 3/1985 | Fleer | 283/82 |
| 4,511,616 | 4/1985 | Pitts et al. | 283/82 |
| 4,637,635 | 1/1987 | Levine | 283/101 |
| 4,675,669 | 6/1987 | Goldman | 283/72 |

*Primary Examiner*—Frank T. Yost
*Assistant Examiner*—Paul M. Heyrana
*Attorney, Agent, or Firm*—Birch, Stewart, Kolasch & Birch

[57] ABSTRACT

A retrieval label for assisting in the selective location of a predetermined object includes a label having a predetermined width and length. The label has a top surface and a bottom surface. An adhesive material is applied to the bottom surface of the label for securing the label to an object. A plurality of address windows are formed in the top surface of the label. A plurality of removable tabs are individually applied to each of the plurality of address windows for providing a closure thereto. An indicating system is provided on the top surface of the label for providing a reference used to identify a predetermined object by removing a predetermined sequence of removable tabs from the top surface of the label for identifying the particular predetermined object.

11 Claims, 3 Drawing Sheets

RETRIEVAL LABEL

BACKGROUND OF THE INVENTION

1. Field of the Invention

The present invention is directed to a retrieval label for identifying a predetermined object to which the label is affixed.

2. Description of Background Art

Currently, we are experiencing an explosion in information. The 1980's have often been referred to as the "information age". A large number of companies and individuals have been inundated with information from a plurality of various sources.

Historically, information received within an office or home is normally arranged in a chronological order. In addition, occasionally information is arranged according to subject matter. However, the retrieval of the information which is received within either the office or home is difficult due to an inability to locate the particular information previously received by the company or individual.

In addition, companies often experience difficulty in maintaining inventory with respect to a particular object. Objects must be arranged in a predetermined sequence to permit an individual to readily locate the object. Further, if files are organized within a home or office according to a particular numbering sequence, then it is necessary to refile any particular file removed from the sequence in the correct numerical order. Thus, a very laborious job is created in continuously refiling files which are removed from a particular sequence to ensure that another individual will be able to retrieve the file which is desired.

SUMMARY AND OBJECTS OF THE INVENTION

It is an object of the present invention to provide a retrieval label that may be instantly and selectively coded and which may be affixed to an object for assisting in the location of an object at a later point in time.

Another object of the present invention is to provide a retrieval label which includes an adhesive material applied to one side thereof for enabling the label to be secured to an object.

A further object of the present invention is to provide a retrieval label which includes a plurality of removable tabs positioned over address windows formed in the top surface of the label. A selected number of removable tabs may be removed from the retrieval label in order to generate a numeric address code used for identifying a particular object to which the retrieval label is affixed. By removing a given tab a highly reflective background is exposed within the same window which can be properly sensed by an electro-optical sensor.

A still further object of the present invention is to provide a retrieval label which includes indicia adjacent to the address windows for providing a visual indication of the specific number assigned to the predetermined object to which the retrieval label is affixed.

A further object of the present invention is to provide indicating means which consist of a reflective material viewable by a photo-optical sensor.

A still further object of the present invention is to provide indicating means which includes a magnetic material detectable by means of an electro-magnetic detector.

A still further object of the present invention is to have all reflective windows exposed and to generate a numeric address code by punching out non-required/-desired windows.

Another object of the present invention is to provide a label as a part of or as a label for an envelope for identifying the zip code of the destination to which the envelope is addressed.

These and other objects of the present invention are achieved by a retrieval label for assisting in the selective location of a predetermined object which includes a label having a predetermined width and length. The label includes a top surface and a bottom surface. An adhesive material is applied to the bottom surface of the label for securing the label to the object. A plurality of address windows are formed in the top surface of the label. A plurality of removable tabs are individually applied to each of the plurality of address windows for providing a closure thereto. An indicating system is provided on the top surface of the label for providing a reference used to identify a predetermined object by removing a predetermined sequence of removable tabs from the top surface of the label for identifying the particular object to which the retrieval label is affixed. In the embodiment of the present invention used in combination with an envelope, removing the tabs would identify the zip code to which the envelope is addressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
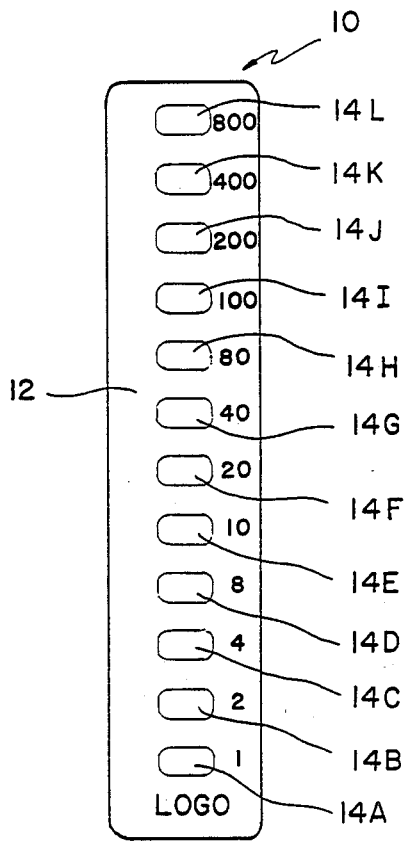
FIG. 1 is a top plan view of a retrieval label according to the present invention.
Figure 2:
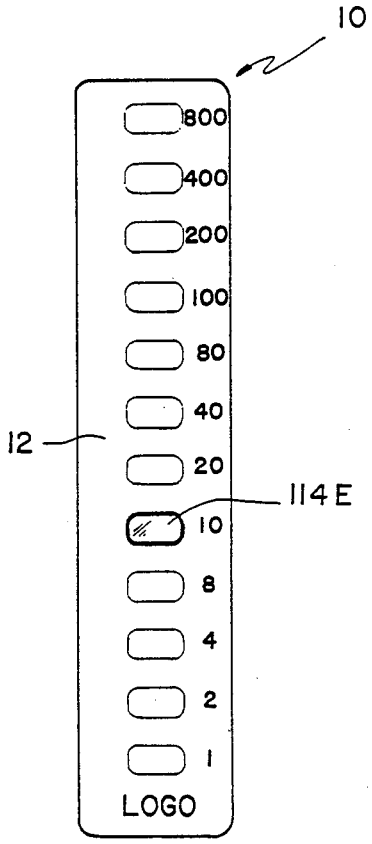
FIG. 2 is a top plan view of a retrieval label according to the present invention with a removable tab removed from one of the address windows.
Figure 3:
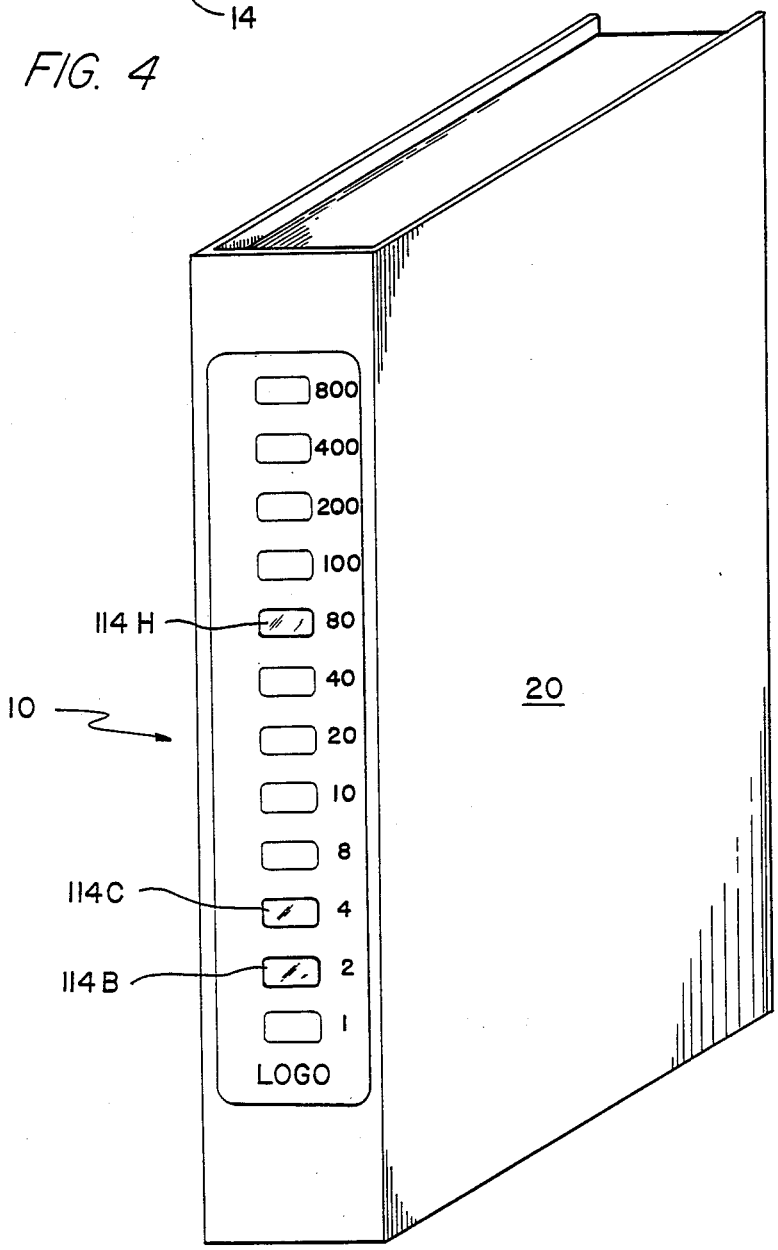
FIG. 3 is a perspective view of the retrieval label affixed to an object.

As illustrated in FIGS. 1–3, a retrievable label 10 is provided with a plurality of address windows 14A–14L applied to a top surface 12 of the label 10. The logo of a particular company purchasing the retrieval labels 10 may be identified on the top surface 12 of the retrievable label 10.

Removable tabs are secured over each of the address windows 14A–14L. The address windows 14A–14L are actually cut into the top surface 12 of the retrievable label 10 by a stamping machine during construction of the retrievable label 10. Thus, the removable tabs may be selectively removed from one of the plurality of address windows 14A–14L to provide a reference for identifying a particular object. An object is identified by selectively removing predetermined removable tabs from the address windows 14A–14L. In this manner, a large number of various objects can be identified by selectively removing predetermined removable tabs from the address windows 14A–14L.

As illustrated in FIGS. 1–3, the retrieval label 10 may include the binary coded decimal (BCD) numbering system adjacent to each of the individual address windows 14A–14L. By utilizing the BCD numbering system, an individual may identify from 1 to 999 distinct objects. Additional address windows may be provided so that a much larger number of objects may be identified with a particular retrieval label 10.

As illustrated in FIG. 2, a removable tab has been removed from the address window 14E to reveal a reflective surface 114E. The particular retrieval label indicated in FIG. 2 would correspond to the number 10. As illustrated in FIG. 3, the retrieval label 10 is affixed to a cassette housing 20. Reflective surfaces 114B, 114C, and 114H are visable for detection. The specific number identified in FIG. 3 is the number 86. Thus, the particular object 20 would be identified with the numerical numbering system 86. The location of the retrieval label 10 on the cassette housing 20 is in a specific location for enabling a photo-optical scanner to align properly with the various address windows on the retrieval label 10.

Figure 4:
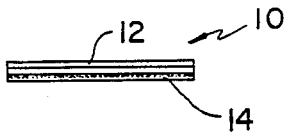
FIG. 4 is a cross-sectional view illustrating the composition of the material from which the retrieval label is constructed.

As illustrated in FIG. 4, the retrieval label 10 consists of a top surface 12 having an adhesive material 14 applied to the bottom surface thereof. A reflective material may be disposed within the top layer 12 or positioned between the top layer 12 and the adhesive layer 14. In constructing the retrieval label 10, a contact cutter is utilized to score the address windows 14A–14L. The scoring of the address windows will not impinge upon the reflective material disposed either adjacent to the top surface 12 or between the top surface 12 and the adhesive surface 14.

Figure 5:
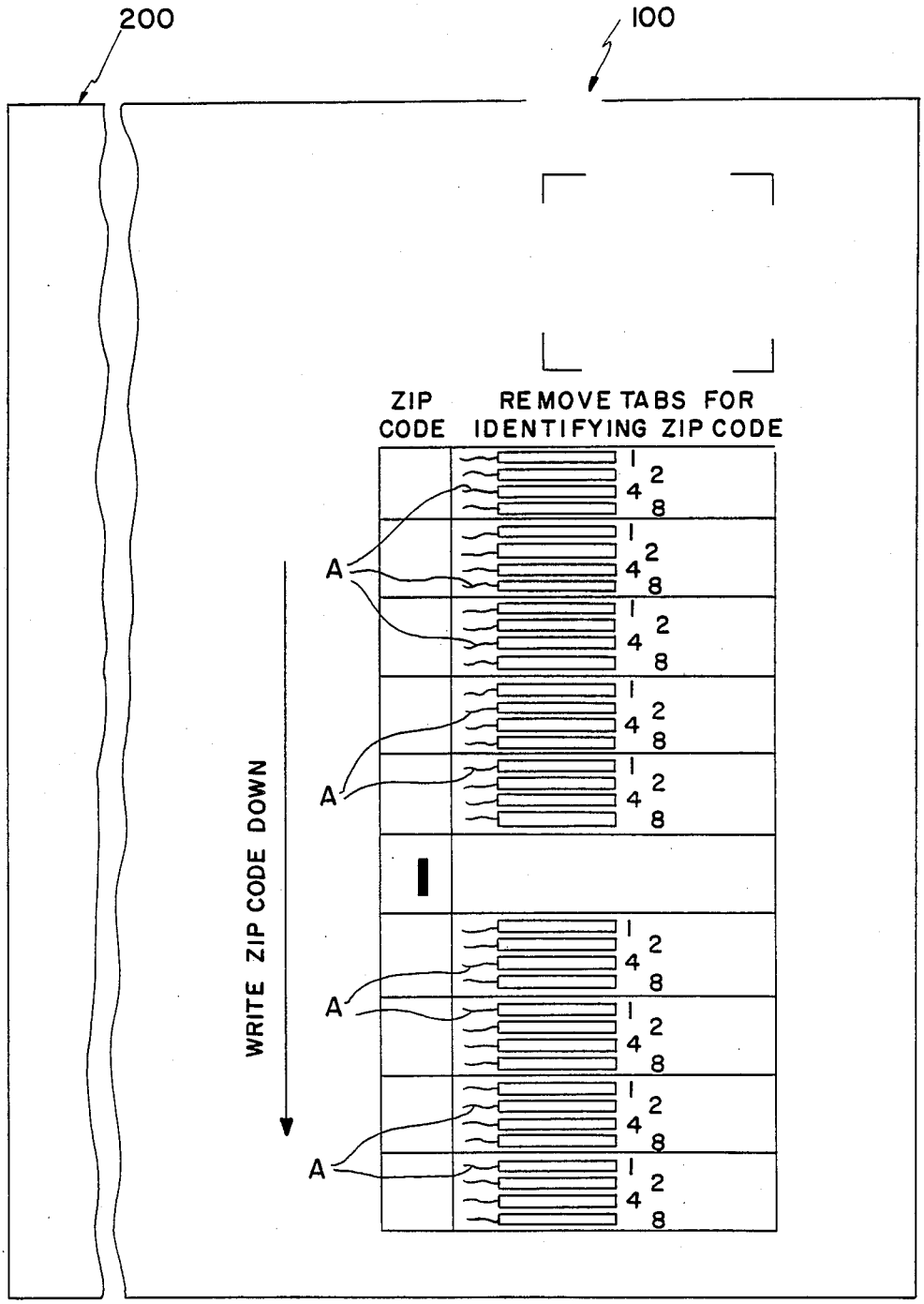
FIG. 5 is an elevational view illustrating the label in combination with an envelope.

As illustrated in FIG. 5, a retrieval label 100 may be affixed to or made an integral part of a conventional envelope 200. The retrieval label 100 may be utilized to depict the zip code to which the envelope is addressed. The new zip codes used in the United States consist of nine (9) digits. Four (4) address windows are necessary for each digit. Thus, a total of thirty-six (36 ) address windows are necessary to properly display an appropriate zip code. Each address window includes a tab for enabling an individual to select a predetermined zip code for a particular envelope. Use of the retrieval label 100 in combination with an envelope 200 will automate mail handling and greatly reduce the time necessary for manually sorting mail.

IN OPERATION

The retrieval label 10 of the present invention is designed to be used with a variety of various objects. As illustrated in FIG. 3, the retrieval label 10 may be secured to a cassette housing 20. The cassette housings 20 may be arranged along a shelf in any order whatsoever. By selectively removing specific removable tabs disposed along the address windows 14A–14L, an individual may specifically identify one of the cassette housings 20. A master file of the contents of the cassette housing 20 relative to the specific number applied to the outer surface thereof is maintained. In attempting to retrieve a particular object, an individual would go to the master file to determine the specific number of the object to be retrieved. Upon determining the number of the specific object, an optical detector is programmed to sense the specific number desired. Thereafter, the optical detector is moved along the shelf of cassette housings 20 until the optical detector encounters the specific object desired. At the particular point where the object is detected, an alarm may be sounded or a light may indicate that the individual has located the specific object.

One of the critical features of the retrieval label 10 is that it eliminates the need for arranging objects in any predetermined order. After an individual is finished with a cassette housing 20, the cassette housing 20 may be positioned back onto a shelf in any location whatsoever. The optical reading system will enable the individual to retrieve the specific object without concern with the refiling of the object back to a specific numerical arrangement. Besides the time saving benefits generated, this random storage and retrieval capability adds also an important element of security to the entire system.

The retrieval label 10 according to the present invention may be used on file jackets, parts, books, or any other object which must be located at a particular point in time. A key feature to the present invention is that it completely eliminates the need of refiling objects back to any specific order. Objects may be arranged on a shelf in any particular order and be retrieved according to the photo-optical scanner utilized together with the retrieval label 10.

The present invention contemplates that a magnetic material may be used in replacement for the reflective material in the retrieval label 10. In this embodiment, a magnetic tape is placed on the retrieval label 10 in the predetermined location for identifying a particular number. An adhesive backing may be used for securing the magnetic material to the retrieval label 10. The magnetic material is exposed for sensing by an electromagnetic sensor. Further, other types of indicating members may be utilized so as to permit a scanning device to select a particular object depending on the order of the exposed windows on the retrieval label 10.

The indicia disposed adjacent to the address windows 14A–14L may be eliminated. If it is desired to maintain the confidence of particular objects, the retrieval label 10 may be affixed thereto without referring to a specific number adjacent to the address windows 14A–14L. In this manner, sensitive material may be reviewed only by individuals having access to the master file and the photo-optical scanner. Thus, a company may maintain in confidence files without concern with the arrangement of the files in any numerical or chronological order.

The retrieval label 10 according to the present invention may be utilized together with a large number of objects to permit an individual to locate an object. The retrieval label 10 may be used together with envelopes or containers for mail to identify a particular zip code for facilitating automation with respect to mail sorting.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A manually manipulatable retrieval label for assisting in the selective location of a predetermined object comprising:

a label having a predetermined width and length, said label including a top surface and a bottom surface;

an adhesive applied to said bottom surface of said label for securing the label to an object;

a plurality of address windows aligned and being juxtaposed adjacent to each other and being formed in said top surface of said label in a predetermined spaced arrangement;

a plurality of removable tabs being individually applied to each of said plurality of address windows for providing a closure thereto; and indicating means being provided on said top surface of said label for providing a reference used to identify a predetermined object by manually removing a predetermined sequence of removable tabs from said top surface of the label for identifying the particular predetermined object.

2. A retrieval label according to claim 1, wherein said indicating means is a reflective material.

3. A retrieval label according to claim 1, and further including indicia disposed adjacent to said plurality of address windows for providing a visual indication of identifying each of said address windows.

4. A retrieval label according to claim 3, wherein the indicia is the binary coded decimal numbering system for providing a number corresponding to selectively removed removable tabs.

5. A manually manipulatable retrieval label for assisting in the selective location of a predetermined object comprising:

a label having a predetermined width and length, said label including a top surface and a bottom surface;

an adhesive applied to said bottom surface of said label for securing the label to an object;

a plurality of address windows being aligned and juxtaposed adjacent to each other and being formed in said top surface of said label in a predetermined spaced arrangement; and a plurality of magnetic material tabs being selectively applied to determined address windows for providing a closure thereto, said plurality of magnetic material tabs forming indicating means on said top surface of said label for providing a reference used to identify a predetermined object by manually affixing a predetermined sequence of magnetic material tabs to said top surface of the label for identifying the particular predetermined object.

6. A manually manipulatable retrieval label for use with an object being mailed for identifying the zip code and for assisting in the selective location and sorting of the object comprising:

a label having a predetermined width and length, said label including a top surface and a bottom surface;

a plurality of address windows being aligned and juxtaposed adjacent to each other and being formed in said top surface of said label in a predetermined spaced arrangement;

a plurality of removable tabs being individually applied to each of said plurality of address windows for providing a closure thereto; and indicating means being provided on said top surface of said label for providing a reference used to identify a zip code for mailing the object by manually removing a predetermined sequence of removable tabs from said top surface of the label for identifying the zip code of the object.

7. A retrieval label according to claim 6, wherein said indicating means is a reflective material.

8. A retrieval label according to claim 7, and further including indicia disposed adjacent to said plurality of address windows for providing a visual indication of identifying each of said address windows.

9. A retrieval label according to claim 8, wherein the indicia is the binary coded decimal numbering system for providing a number corresponding to selectively removed removable tabs.

10. A retrieval label according to claim 6, wherein said label is an integral part of the object.

11. A retrieval label according to claim 6, wherein an adhesive is applied to said bottom surface of said label for securing the label to the object.

* * * * *